United States Patent [19]

Absil et al.

[11] 4,144,164

[45] Mar. 13, 1979

[54] PROCESS FOR SEPARATING MIXTURES OF PARTICLES

[75] Inventors: Joseph H. Absil, Arlington Heights, Ill.; Heinrich J. Mengelers, Brunssum, Netherlands

[73] Assignee: Stamicarbon, B.V., Geleen, Netherlands

[21] Appl. No.: 835,031

[22] Filed: Sep. 20, 1977

[51] Int. Cl.[2] ..... B03B 9/00

[52] U.S. Cl. ..... 209/12; 209/39; 209/172.5

[58] Field of Search ..... 209/172.5, 12, 17, 39, 209/38

[56] References Cited

U.S. PATENT DOCUMENTS

| | | | |
|---|---|---|---|
| 2,623,637 | 12/1952 | Fontein | 209/172.5 |
| 2,932,395 | 4/1960 | Marot | 209/172.5 |

FOREIGN PATENT DOCUMENTS

| | | | |
|---|---|---|---|
| 791520 | 3/1958 | United Kingdom | 209/172.5 |

*Primary Examiner*—Ralph J. Hill

*Attorney, Agent, or Firm*—Cushman, Darby & Cushman

[57] ABSTRACT

A process for separating relatively fine solid particles differing in size and specific gravity by the use of a heavy medium which includes magnetizable particles where a mixture containing the fine particles to be recovered and the heavy medium are fed under pressure to a specific gravity separating cyclone which divides the mixture into a relatively fine specifically light fraction from which the magnetizable particles of the heavy medium are subsequently removed for re-use in the system while the diluted flow of the fine specifically light particles to be recovered is fed to a thickening cyclone which separates the bulk of the particles from the carrying liquid; the fine particles are then recovered from a filter screen while a portion of the liquid is further used in the process to facilitate recovery of the magnetic particles from the specifically heavy fraction derived from the cyclone.

9 Claims, 2 Drawing Figures

PROCESS FOR SEPARATING MIXTURES OF PARTICLES

BACKGROUND AND BRIEF DESCRIPTION OF THE INVENTION

The present invention relates to the field of particle separation and, more specifically, to recovery of a fine grade coal by means of heavy media suspensions.

As a result of the increasing scarcity of raw materials and fuels, it is desirable to recover as much usable coal as is economically and physically possible.

As is well known, one of the chief difficulties in using coal as a fuel is the pollution that results as a consequence of the high sulfur content in the coal. It has been found, however, that very fine coal is relatively free of sulfur thus rendering the recovery of fine coal fractions highly desirable.

A number of processes have been developed for recovering fine coal on the order of 0.5mm or smaller. One such process is froth flotation, which is, however, less suitable for some types of coal. For instance, oxidized coal cannot efficiently be recovered by froth flotation. A more suitable process is then a separation according to specific gravity using liquid separating media.

It has been proposed to remove the fine particles from a raw coal feed product containing also coarser particles in a classifying step, usually called de-sliming, and separating these fine particles into a fine light fraction and a fine heavy fraction in a separate separating system. To obtain a high efficiency, the classifying step is usually carried out by screening while rinsing the product being screened with water. This involves the introduction of an amount of water which has a diluting effect on the separating medium that has to be compensated for by increasing the specific gravity of the heavy medium with which the product is mixed prior to the specific gravity separation.

According to U.S. Pat. No. 2,932,395 of Apr. 20, 1960, this drawback can be eliminated by rinsing the product being screened with heavy medium in lieu of water. However, as a practical matter, in this process, the de-sliming has to be carried out with a large amount of heavy medium to avoid unsatisfactory removal of the fine particles and accumulation thereof in the heavy medium circulating through the process. As a consequence, the fine particles fed to the separate separating system, which consists of one or more heavy medium cyclones, are accompanied by a comparatively large amount of heavy medium and the solids concentration in the feed to the hydrocyclone(s) is lower than admissible for an efficient separation. As a result, the amount of heavy medium to be treated is substantially increased and the capital investment for the equipment in the medium cleaning system is increased correspondingly. Also, the screening equipment required for the classifying step adds substantially to the capital investment of the plant.

Apart from the initial capital investment in constructing a separating process plant, one of the major cost factors in running such plants resides in the consumption of fresh water needed to efficiently carry out the process and the treatment of the amount of water circulating in the process. Accordingly, the prior art has endeavored to reduce the consumption of fresh water required to successfully effect coal washing and particle separation. However, such processes have, in general, resulted in an increase in equipment cost per unit quantity of coal processed per unit of time as a consequence of the necessity of clarifying or purifying the water used in the process.

Further disclosures representative of the prior art in this field are U.S. Pat. Nos. 2,387,866 of Oct. 30, 1945; 2,623,637 of Dec. 30, 1952; 2,984,355 of May 16, 1961 and 2,998,882 of Sept. 5, 1961.

It is an object of the present invention to provide a coal cleaning and recovery process which effects a substantial saving in capital investment and also in the quantity of water required in the process. Further, it is an object of the present invention to provide a separating process capable of recovering extremely fine particles of coal as well as for providing a process that has an inherent flexibility in selecting the level of discrimination among the particles of coal and refuse to be recovered.

To summarize the process of the present invention, raw coal containing coal and shale in a range of particle sizes is mixed with magnetic particles in suspension and fed to a first stage separator which is preferably a heavy medium cyclone where the raw coal is separated into a heavy fraction and a light fraction. The two fractions are then fed to draining screens and washed on washing screens by spraying with a liquid such as clarified water and fresh water to remove the fine suspension. From the draining screens is derived a first mixture, a portion of which is fed to a second stage separator which is preferably also a heavy medium cyclone. The dilute suspensions drained from the two washing screens are fed separately to mixing tanks which receive separately the heavy and light fractions recovered from the second stage separator. The coarse fractions from the screens are, of course, removed from the process, as coarse clean coal and refuse.

The diluted fractions obtained from the second stage separator are then separately fed to sieve bends to obtain tertiary, relatively coarse light and heavy and relatively fine light and heavy fractions which are then fed to magnetic separators to recover the magnetic particles for re-use in the process. The diluted fine light fraction from which the magnetic particles have been recovered is fed to a thickening cyclone and at least a portion of the liquid recovered from this cyclone is employed as a dilution liquid for the secondary heavy fractions from the second stage separator. With this arrangement, the necessity of using large quantities of either clarified or fresh water in the recovery of the magnetic particles at this stage of the process can be entirely eliminated without any significant reduction in the proportion of magnetic particles recovered.

The foregoing and other advantages will become apparent as consideration is given to the following detailed description of the invention and accompanying drawing in which:

DETAILED DESCRIPTION OF THE INVENTION

Figure 1:
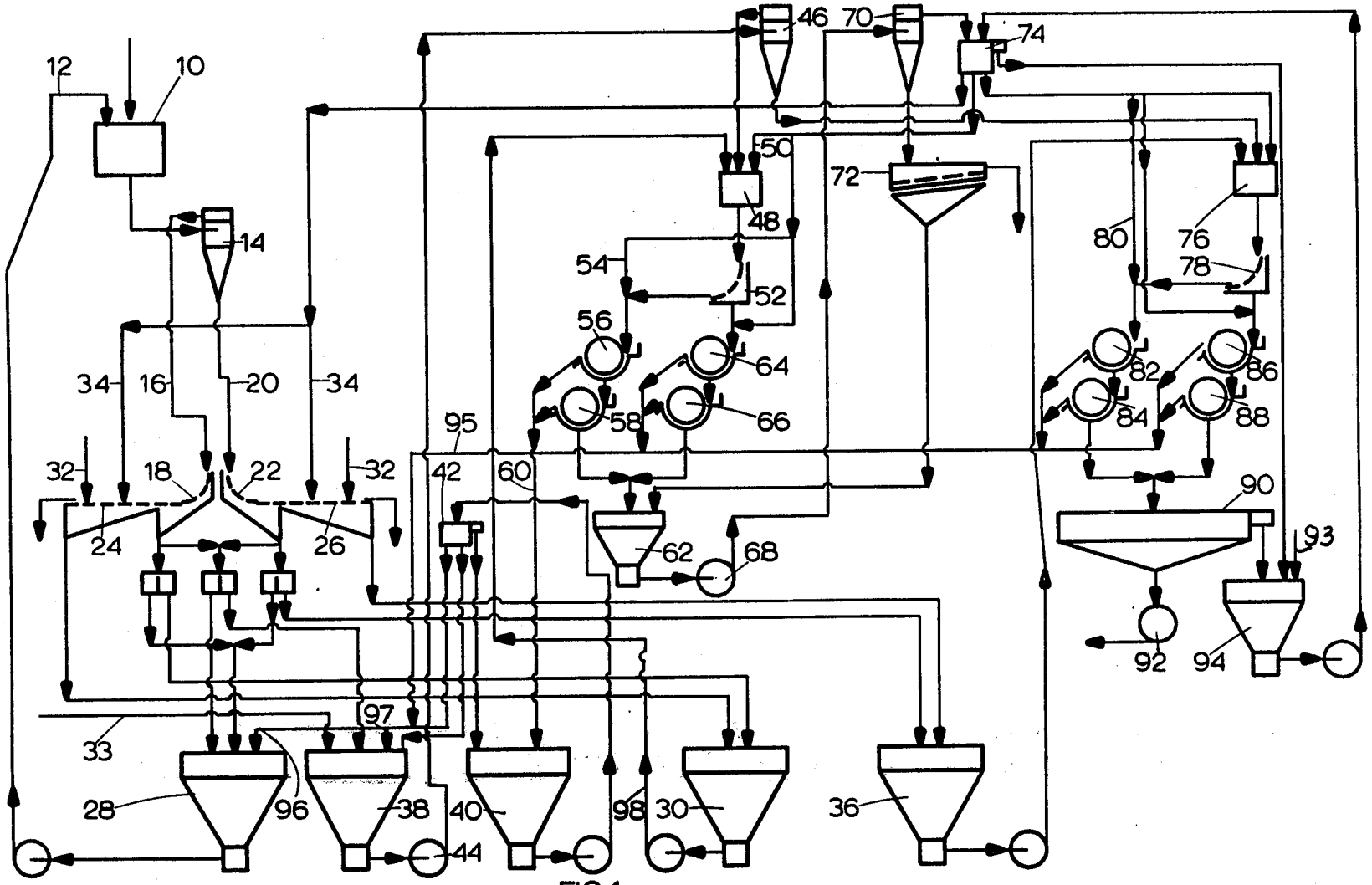
FIG. 1 is a schematic illustration of the various stages of one process of the present invention wherein the lines represent conduits and the arrows the direction of flow in each conduit.
Figure 2:
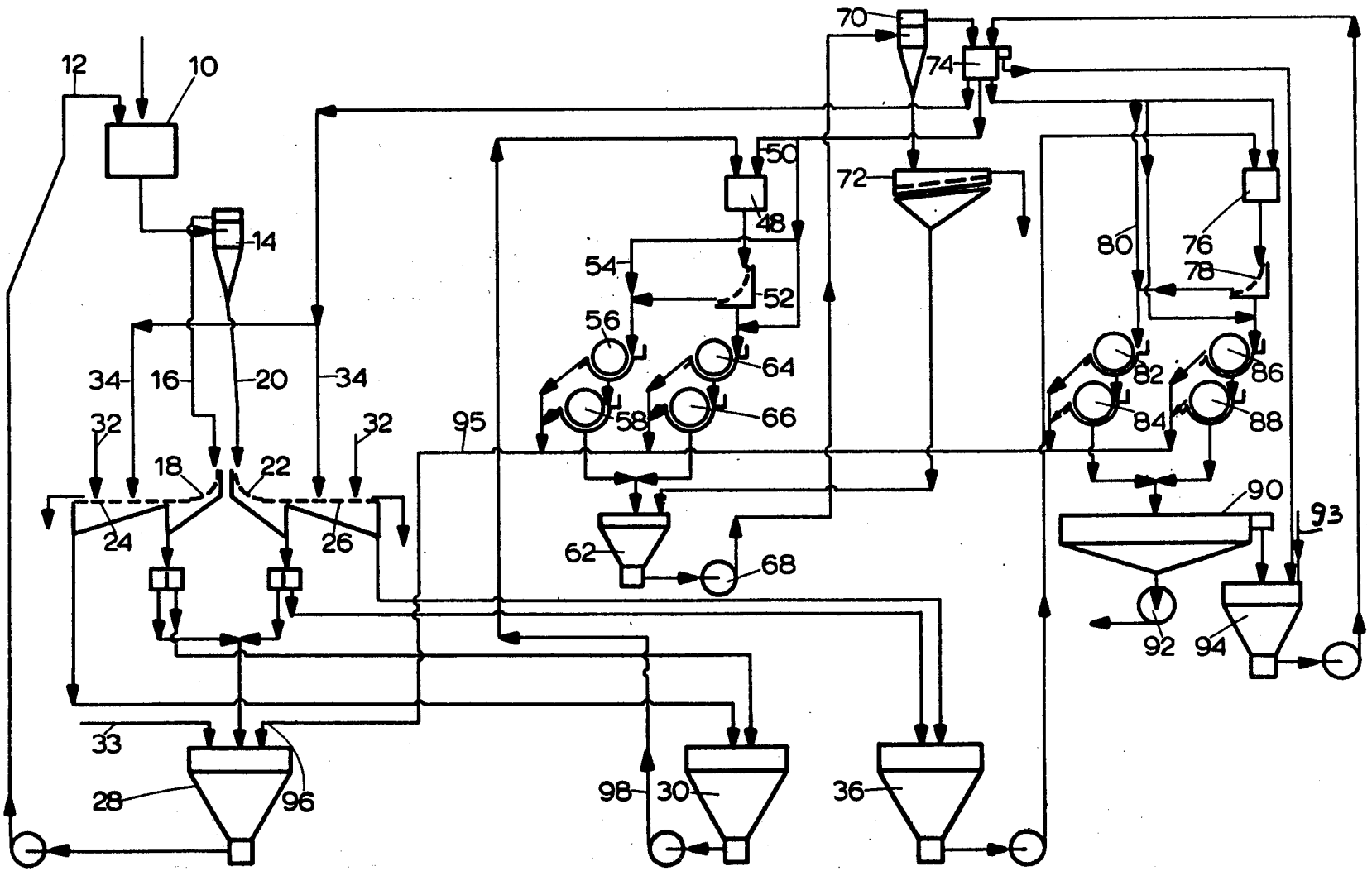
FIG. 2 is a schematic illustration of the various stages of a process of another embodiment of the present invention, wherein the same numerals designate corresponding parts as shown in FIG. 1.

Referring now to the drawing, raw coal which is a mixture of coal, shale and various refuse particles which has first been screened to remove all particles larger than a predetermined size such as, for example, approximately a half-inch, is introduced into a mixing tank 10 together with a suspension of magnetizable particles which may include re-cycled fine coal and refuse elements at 12.

From the outlet of the mixing tank 10, the mixture of raw coal and separating suspension is fed to a first separating stage which may consist of a heavy medium cyclone 14, or a plurality of heavy medium cyclones in parallel of which function it is to separate the raw coal mixture according to the density of the particles. Thus, a relatively light fraction will be delivered from the first separating stage 14 and introduced through a conduit 16 to a first draining screen means 18 while a relatively heavy fraction will be introduced through a conduit 20 to a second draining screen means 22.

Coarse particles of a size larger than the apertures of the draining screen means 18 and 22, e.g. 0.5 mm, will pass to washing screens 24 and 26, respectively, from whence they will be discharged from the process.

A portion of the undiluted separating suspensions containing fine coal and refuse particles that have passed through the draining screen means 18 and 22 is passed directly to a heavy medium sump 28 which is also employed to adjust the specific gravity of the separating suspension collected therein before it is recycled through conduit 12 to the mixing tank 10.

Another portion of the undiluted suspension passing through screen means 18 is passed to a sump tank 30 in which the dilute medium is collected which is obtained from washing screen 24 where the coarse light fraction is continuously washed by clarified liquid or fresh water from sprays 32 or from a re-cycled liquid as from 34 which is obtained as described hereinafter. It will be apparent that the sump tank 30 will contain fine particles of coal, e.g. - 0.5 mm, as well as magnetizable particles in a diluted suspension.

Similarly, another portion of the undiluted heavy fraction from the second draining screen means 22 is passed to a sump tank 36 in which diluted suspension is collected which is obtained from washing screen 26 where the coarse heavy fraction is washed with liquids from the same sources as the liquid for washing the coarse light fraction as indicated in the drawing. Thus, sump tank 36 contains a diluted separating suspension and relatively fine heavy particles.

Alternatively, it is possible to feed another portion of the combined undiluted drawings from first and second drain screens 18 and 22 to sump tank 38. This sump also receives separating suspension recovered elsewhere in the process from the distribution box 42. The specific gravity of the separating suspension in the sump 38 is carefully controlled, e.g., by the addition of a diluting liquid from pipe 33.

According to the present invention, it is desired to recover the fine coal particles from the mixture in sump tank 38 while not only not increasing the consumption of water required to run the process but, in fact, by a reduction and conservation in terms of the water used as contrasted with the processes of the prior art. This is in addition to the water saving achieved by eliminating the de-sliming screens upstream of the first separating stage 14.

To this end, a pump 44, of conventional structure, is employed to pump the mixture from sump tank 38 to a heavy medium cyclone 46 or a plurality of heavy medium cyclones so that the mixture introduced into the heavy medium cyclone 46 is under pressure, such as on the order of the equivalent of approximately 30 feet of feed mixture. The pressure, in any event, should not be below 25 feet of feed mixture. The heavy medium cyclone 46 has smaller dimensions than the heavy medium cyclone 14.

With this arrangement, a more efficient separation of fine particles can be achieved than is possible with a cyclone of larger diameter.

The heavy medium cyclone 46, with the specific gravity of the mixture in sump 38 properly selected, will divide the mixture into a relatively fine specifically light fraction, which exits at the top of the heavy medium cyclone 46, and a relatively fine specifically heavy fraction which exits at the bottom thereof.

The light fraction is passed to a mixing tank 48 where diluted suspension from sump 30 is added and, if desired, liquid through conduit 50 in order to form a diluted fraction including the relatively fine light particles. From mixing tank 48 this diluted fraction is subjected to magnetic separation. However, to improve the efficiency of the magnetic separation process, the diluted fraction of relatively fine light particles is first passed over a classifying means 52 such as a sieve bend in order to rapidly and efficiently separate out coal particles of an average size greater than a predetermined size. The principal object of classifying the first diluted fraction is to optimally remove fine non-magnetic particles from the magnetic particles and thus prevent accumulation of non-magnetic particles in the circulating separating suspension. The larger sized coal particles which are accompanied by a small amount of magnetizable particles are next diluted through conduit 54 with a liquid, the origin of which will be described hereinafter, and then the larger particles are passed to a first magnetic separator 56 which removes a major portion of the magnetic particles from the mixture. Then, the diluted fraction of larger particles is passed to a second magnetic separator 58 which effects removal of substantially all of the magnetic particles and delivers them to a conduit 60 which passes the thus recovered magnetic particles to sump 40 while the recovered and separated coal particles together with the bulk of the liquid are fed to a sump 62.

The finer coal particles, the magnetic particles and the liquid that pass through the classifying means 52 are similarly, if desired after dilution, treated in third and fourth magnetic separators, 64 and 66, respectively, with the recovered coal particles delivered also to sump 62 while the magnetizable particles are fed to conduit 60. The contents of sump 62, therefore, is a diluted fraction of substantially only fine coal particles.

According to the present invention the diluted fraction in sump 62 is passed through pump 68 to a thickening cyclone 70, the structure and operation of which is well known in this art. Thickening cyclone 70 effects separation of the bulk of the fine coal particles from the liquid whereby the coal particles exit at the bottom of the cyclone and are passed to a de-watering means 72, such as a filter screen, from which the coal particles are recovered while the liquid is passed back to sump 62 for re-use in the process. The liquid recovered from the diluted fraction fed to thickening cyclone 70 exits from the top of this cyclone and is fed to a head tank 74. Thereafter, a portion of the recovered liquid is passed to sprays 34 to be used as rinsing water and another portion of it to a mixing tank 76 where it is combined with the heavy fraction separated from the mixture fed to the heavy media cyclone 46. This heavy fraction will comprise generally refuse particles and magnetizable particles. It is desirable, of course, according to the present invention, to recover also these magnetizable particles for re-use in the system while conserving or reducing the liquid required to efficiently carry out such a recovery. Thus, the liquid separated from the first diluted fraction is employed at this point to facilitate efficient separation and recovery of these magnetizable particles by being combined with the heavy fraction to form a second diluted fraction.

From tank 76 the second diluted fraction is passed to classifying means 78 such as the sieve bend which, as in the previous circumstance, separates the larger sized fraction refuse particles from the second diluted fraction. The larger size particles are then diluted through conduit 80 with another portion of the liquid separated from thickening cyclone 70 to permit efficient separation in the first magnetic separator 82 which is followed by a second magnetic separator 84. The magnetic particles recovered from these magnetic separators 82 and 84 are passed to the heavy medium sump 40 so that they can be introduced into the initial separation stage of this process. Likewise, the second diluted fraction passing through sieve bend 78 is passed, if desired after dilution, to third and fourth magnetic separators 86 and 88, respectively. The magnetizable particles recovered from these separators are also passed back to the sump 40 while the mixture of refuse particles and water from the magnetic separators 82–88 is passed to a thickener 90 which eliminates the refuse particles at 92 from the process while returning clarified liquid at 94 to the head tank 74 thereby resulting in additional conservation of water. Tank 94 also collects the overflow from thickener 90 and head tank 74 and, if necessary, fresh water may be added to tank 94 as through a conduit 93.

The process of the present invention is capable of great flexibility corresponding to variations in the character and quality of the raw material input. For example, where the first stage separating means 14 is capable of providing adequate separation between the fine specifically light fraction and the fine specifically heavy fraction, it will not be necessary to feed the mixture containing the fine particles to sump 38 and then through the separation process including heavy medium cyclone 46. Instead, a portion of the undiluted suspension from the first draining screen means 18 can be combined with all of the diluted suspension from the first washing screen 24 in sump 30 and the combined suspensions can be fed directly through conduit 98 to mixing tank 48 for the magnetic separation. Likewise, a portion of the undiluted suspension from the second draining screen means 22 can be combined with the diluted suspension from the second washing screen 26 in sump 36 to form a mixture that can be subjected directly to magnetic separation from mixing tank 76. Such a procedure will eliminate the necessity of operating sumps 38 and 40 as well as heavy medium cyclone 46. In that case, the recovered concentrated separating suspension is fed to sump tank 28 through conduits 95 and 96.

It will be apparent that with the process of the present invention running within the rated capacity of the various elements thereof, a liquid balance can be readily achieved and maintained particularly from the sump 38 to the filter screen 72 while including the recovery of both fine coal particles of a size 0.5 to 0 mm and magnetizable particles from the fractions separated in heavy medium cyclone 46. It is also believed apparent that the total quantity of water required to operate the system for a given raw product input per hour will be substantially less than has previously been the case where the separation of the fine coal products is to the same degree of particle size.

Also of significance is the efficiency of the process in terms of the size of the fine particles of coal that can be recovered, while conserving water, without the addition of expensive de-sliming screens or a multiplicity of settling tanks or thickeners.

Having described the invention, it will be obvious to those skilled in the art that various modifications may be made in the process of the present invention without departing from the spirit and scope thereof as defined in the appended claims.

What is claimed is:

1. In a continuous process for separating a mixture including relatively fine solid particles, differing in size and specific gravity, with the aid of a heavy medium which includes magnetizable particles as weighting material, the process including the steps of:

(a) feeding the mixture including the relatively fine particles to a specific gravity separating means to divide the mixture into a relatively fine specifically light fraction and a relatively fine specifically heavy fraction, (b) combining said relatively fine specifically light fraction with a liquid to form a first diluted fraction, (c) removing the magnetizable particles from said first diluted fraction by magnetic separation, (d) after the removal of the magnetizable particles, separating the bulk of the relatively fine specifically light particles from the liquid in said first diluted fraction, the improvement comprising:

passing at least a portion of the liquid remaining after separation of the bulk of the light particles from said first diluted fraction to a tank, combining the liquid in said tank with said relatively fine specifically heavy fraction to form a second diluted fraction, removing magnetizable particles from said second diluted fraction by magnetic separation, after the removal of the bulk of the magnetizable particles from said second diluted fraction, separating the bulk of the relatively fine specifically heavy particles from the liquid in said second diluted fraction, and recovering the liquid from said second diluted fraction for re-use in the process.

2. The process as claimed in claim 1 wherein said specific gravity separating means comprises a heavy medium cyclone and said step of feeding the mixture including the relatively fine particles to a specific gravity separating means includes the step of feeding said mixture under a pressure of at least 25 feet of feed mixture to said heavy medium cyclone.

3. The process as claimed in claim 1 wherein, upstream of the magnetic separation of said first diluted fraction, said first diluted fraction is passed over a classifying means to remove from said first diluted fraction particles having an average size larger than a predetermined size, and the magnetic separation includes passing said larger particles to a first light fraction magnetic separator to remove a major portion of the magnetizable particles mixed therewith and then to a second magnetic separator to remove substantially all of the remaining magnetizable particles therefrom, and the portion of said first diluted fraction that comprises the bulk of the particles smaller than said predetermined size is fed to a third magnetic separator for removing a major portion of the magnetizable particles mixed therewith and then to a fourth magnetic separator to remove substantially all of the magnetizable particles therefrom.

4. The process as claimed in claim 3 including the step of diluting said larger particles upstream of said first magnetic separator with a portion of the liquid remaining after separation of the bulk of the light particles from said first diluted fraction.

5. The process as claimed in claim 4, wherein, upstream of the magnetic separation of said second diluted fraction, said second diluted fraction is passed over a classifying means to remove from said second diluted fraction particles having an average size larger than a predetermined size, and the magnetic separation includes passing said larger particles to a first heavy fraction magnetic separator to remove a major portion of the magnetizable particles therefrom and then to a second heavy fraction magnetic separator to remove substantially all of the remaining magnetizable particles therefrom, and the portion of said second diluted fraction that comprises the bulk of the particles smaller than said predetermined size is fed to a third heavy fraction magnetic separator for removing a major portion of the magnetizable particles mixed therewith and then to a fourth heavy fraction magnetic separator to remove substantially all of the magnetizable particles therefrom.

6. The process as claimed in claim 5 including the step of diluting said larger particles, separated by the classifying means from the second diluted fraction, upstream of said first heavy fraction magnetic separator with a portion of the liquid remaining after separation of the bulk of the light particles from said first diluted fraction.

7. The process as claimed in claim 6 including the steps of passing the second diluted fraction, after removal of the magnetizable particles therefrom to a thickener, recovering liquid from the thickener and combining the recovered liquid with the liquid remaining after separation of the bulk of the light particles from said first diluted fraction.

8. In a continuous process for separating a mixture of solid particles differing in size and specific gravity with the aid of a heavy medium comprising magnetizable particles as weighting material including the steps of:

(a) feeding said mixture to a separating means to divide said mixture into a specifically heavy and a specifically light fraction, (b) feeding said specifically light fraction over a first draining screen means and a first washing screen means and said specifically heavy fraction over a second draining screen means and a second washing screen means while spraying a liquid onto said fractions on each said washing screen means and recovering a washed relatively coarse fraction from each of said specifically heavy and light fractions and undiluted suspensions containing relatively fine particles from said first and second draining screen means, and dilute suspensions containing relatively fine particles from said first and second washing screen means, (c) re-cycling a portion of said undiluted suspensions to said separating means, (d) adding the remainder of the undiluted suspension from said first draining screen means to the diluted suspension from said first washing screen means and the remainder of the undiluted suspension from said second draining screen means to the diluted suspension from said second washing screen means, (e) separating magnetizable particles and relatively fine particles in each of said diluted suspensions in separate magnetic separation steps, the improvement comprising:

recovering the bulk of the relatively fine specifically light particles from the suspension remaining after removal of the magnetizable particles from the combined suspensions from said first draining and washing screen means and using at least a portion of the remaining liquid for diluting the combined suspensions from said second draining and washing screen means prior to subjecting said combined suspensions from said second draining and washing screen means to said magnetic separation, removing the bulk of the solids comprising the fine specifically heavy particles from the suspension of non-magnetizable particles remaining after removal of the magnetizable particles from the combined suspensions from said second draining and washing screen means by said magnetic separation and re-cycling the remaining liquid for re-use in said process.

9. In a continuous process for separating a mixture of solid particles differing in size and specific gravity with the aid of a heavy medium comprising magnetizable particles as weighting material including the steps of:

(a) feeding said mixture to a first separating means to divide said mixture into a specifically heavy and a specifically light fraction, (b) feeding said specifically light fraction over a first draining screen means and a first washing screen means and said specifically heavy fraction over a second draining screen means and a second washing screen means while spraying a liquid onto said fractions on each said washing screen means and recovering a washed relatively coarse fraction from each of said specifically heavy and light fractions and undiluted suspensions containing relatively fine particles from said first and second draining screen means, and dilute suspensions containing relatively fine particles from said first and second washing screen means, (c) re-cycling a portion of said undiluted suspensions to said separating means, the improvement comprising:

feeding the remainder of said undiluted suspensions to a second separating means to divide said undiluted suspensions into a relatively fine specifically light fraction and a relatively fine specifically heavy fraction, combining said relatively fine specifically light fraction with the diluted suspension from said first washing screen means to form a first combined suspension and combining said relatively fine specifically heavy fraction with the diluted suspension from said second washing screen means to form a second combined suspension and separately subjecting said first and second combined suspensions to magnetic separation, recovering the bulk of the relatively fine specifically light particles from the suspension remaining after removal of the magnetizable particles from said first combined suspension and using at least a portion of the remaining liquid for diluting said second combined suspension prior to subjecting said second combined suspension to said magnetic separation, removing the bulk of the solids comprising the fine specifically heavy particles from the suspension of non-magnetizable particles remaining after the removal of the magnetizable particles from said second combined suspension by magnetic separation, and re-cycling the remaining liquid for re-use in the process.

* * * * *